US007707917B2

(12) United States Patent
Ratz

(10) Patent No.: US 7,707,917 B2
(45) Date of Patent: May 4, 2010

(54) METHOD AND DEVICES FOR SEVERING SHEETS FROM AND/OR FEEDING A WEB INTO A SUBSEQUENT PROCESSING STAGE

(75) Inventor: Holger Ratz, Frankenthal (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 672 days.

(21) Appl. No.: 11/547,680

(22) PCT Filed: Mar. 17, 2005

(86) PCT No.: PCT/EP2005/051246

§ 371 (c)(1),
(2), (4) Date: Oct. 5, 2006

(87) PCT Pub. No.: WO2005/097645

PCT Pub. Date: Oct. 20, 2005

(65) Prior Publication Data

US 2008/0257122 A1 Oct. 23, 2008

(30) Foreign Application Priority Data

Apr. 5, 2004 (DE) ..... 10 2004 016 674
Nov. 5, 2004 (DE) ..... 10 2004 053 536

(51) Int. Cl.
*B65H 26/02* (2006.01)

(52) U.S. Cl. ..... 83/60; 83/949; 83/DIG. 1

(58) Field of Classification Search ..... 83/58, 83/60, 367–370, 949, DIG. 1
See application file for complete search history.

(56) References Cited

U.S. PATENT DOCUMENTS 3,928,844 A * 12/1975 Meihofer ..... 83/371
4,809,573 A * 3/1989 Welch ..... 83/360
4,949,607 A * 8/1990 Yuito ..... 83/367
5,241,884 A * 9/1993 Smithe et al. ..... 83/369
5,279,195 A * 1/1994 Breton ..... 83/370
5,582,359 A 12/1996 Wicha
5,901,647 A 5/1999 Kohlmann
6,689,031 B2 * 2/2004 Nanba et al. ..... 493/22
2002/0088323 A1 * 7/2002 Hashigaya ..... 83/369
2003/0106450 A1 6/2003 Honeck et al.

FOREIGN PATENT DOCUMENTS

DE 36 39 972 5/1988

(Continued)

OTHER PUBLICATIONS

Clipped image of DE 4210190 (Behmel), Sep. 1993.*

*Primary Examiner*—Stephen Choi
(74) *Attorney, Agent, or Firm*—Jones, Tullar & Cooper, P.C

(57) ABSTRACT

A web is fed into a sheet severer prior to its entry into a subsequent processing stage. The sheets, which have been severed from the web are then cut into required product sections in a cross-cutter which is associated with this subsequent processing stage. In order to achieve an accurately registered severing process, using the sheet severer, it is triggered by a signal which represents the phase position of the cross-cutter. The sheet severer is thus phase-correlated in relation to the phase position of the cross-cutter.

22 Claims, 6 Drawing Sheets

FOREIGN PATENT DOCUMENTS

| | | |
|---|---|---|
| DE | 42 10 190 | 9/1993 |
| DE | 44 25 662 | 11/1995 |
| DE | 195 25 169 | 2/2000 |
| DE | 101 59 937 | 6/2003 |
| DE | 102 22 586 | 12/2003 |
| DE | 102 22 587 | 12/2003 |
| JP | 04-175165 | 6/1992 |
| WO | WO 03/095348 | 11/2003 |

* cited by examiner

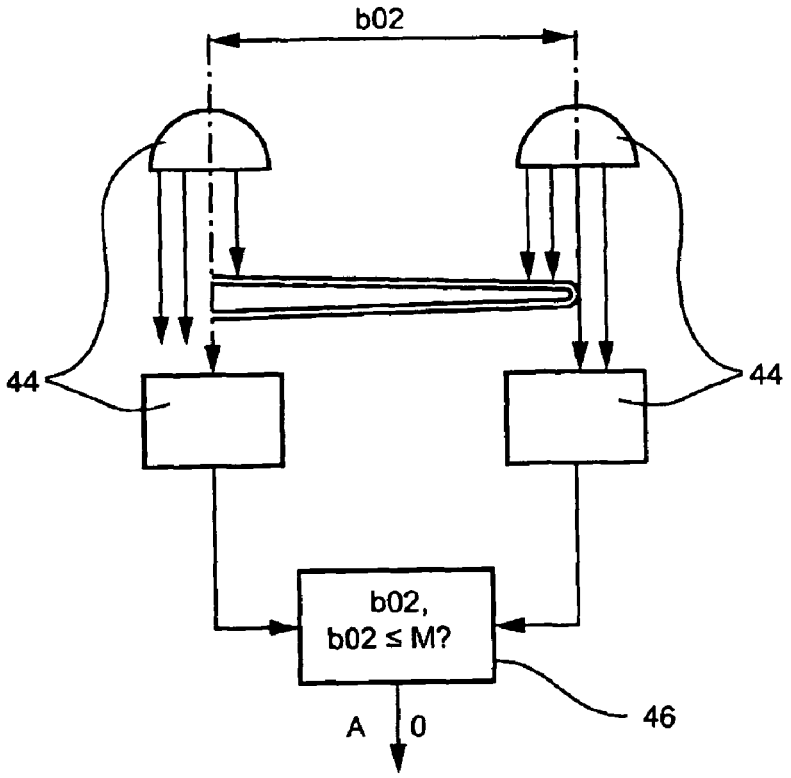
a)
Fig. 3
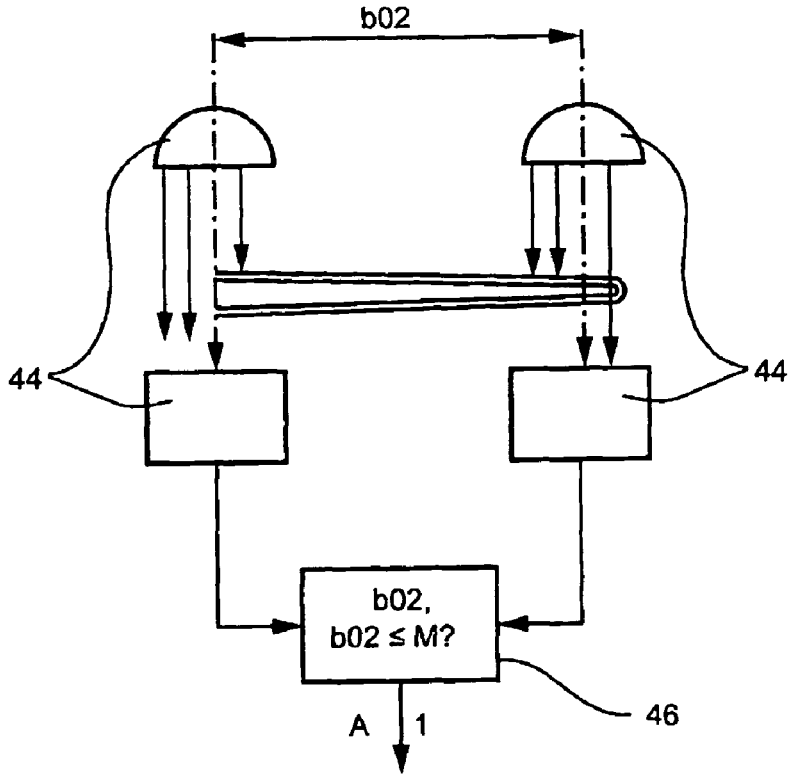
b)

METHOD AND DEVICES FOR SEVERING SHEETS FROM AND/OR FEEDING A WEB INTO A SUBSEQUENT PROCESSING STAGE

CROSS-REFERENCE TO RELATED APPLICATIONS

This patent application is the U.S. national phase, under 35 USC 371, of PCT/EP2005/051246, filed Mar. 17, 2005; published as WO 2005/097645 A1 on Oct. 20, 2005 and claiming priority to DE 10 2004 016 674.9, filed Apr. 5, 2004 and to DE 10 2004 053 536.1, filed Nov. 5, 2004, the disclosures of which are expressly incorporated herein by reference.

FIELD OF THE INVENTION

The present invention is directed to a method and to devices for severing a continuous web and/or for feeding such a continuous into a further processing stage. The continuous web is cut transversely into product sections in a processing stage that is subsequent to an initial severing stage.

BACKGROUND OF THE INVENTION

DE 195 25 169 C2 discloses a severing device which is arranged in the path of the continuous web, and which severing device is arranged, in the path of the continuous web, upstream of the transverse cutting arrangement consisting of a blade cylinder and a cooperating cutting groove and folding blade cylinder. The transverse cutting device is assigned to the subsequent folding apparatus, and cuts the continuous web into product sections in the course of its operation.

A continuous web guidance device between a former and a folding apparatus and having a severing device is known from DE 101 59 937 A1. The severing device severs the continuous web in case of a stoppage of the folding system. The severing device has a blade element with an actuating assembly which is operated by a pressure medium. A clamping device is arranged upstream of the severing device.

DE 42 10 190 A1 discloses a severing device with a safety arrangement. A severed continuous web is moved out of the operating path of the continuous web in the course of being severed.

DE 102 22 586 A1 discloses an arrangement for treating a web of material. Respective web severing devices are provided on a web travel path both upstream and downstream of a material treatment station.

Two severing devices, which are arranged upstream of a folding unit, are disclosed in JP 04-175 165 A. The first severing device cuts through the running web, and a continuous web section, which was deflected by the first cut, is cut off by the second severing device while the machine is stopped.

SUMMARY OF THE INVENTION

The present invention is directed to providing a dependable method regarding the malfunction-free start of the operation of, and the provision of devices which are suitable for severing and/or for the secure feeding of a continuous web into a further processing stage.

In accordance with the present invention, the object is attained by the provision of a method and a device for severing and subsequently transversely cross-cutting and folding a web. The web is initially severed and is then subsequently cross-cut into the plurality of product sections which are then folded. The severing of the web is accomplished, in a registration-correct manner by the severing device. This is triggered in a phase-correlated manner, with respect to the phase relationship of the transverse cutting device, by a signal that represents the phase relationship of the transverse cutting arrangement.

The advantages to be gained by the present invention lie, in particular, in that malfunctions, arising because of irregularities in the transverse and/or in the longitudinal extension of the continuous web to be folded, are avoided in the course of feeding a continuous web after severing, or in the course of the first feed-in of a continuous web into a folding apparatus.

The start of a continuous web which has been obtained in case of an emergency stop, or also a leading start, which was obtained during the set-up, can, in principle, be oriented in the longitudinal direction in any way with regard to its angular position. In particular, severing of the web can take place at any arbitrary position, with respect to the printed image that is located on the continuous web. The angular position of a transverse blade and of other cylinders of the folding apparatus are brought into longitudinal registration with the printed image, such as, for example, by the electronic or mechanical synchronization of the drive mechanism of the folding apparatus with the angular position of the cylinders applying the printed image, and/or the employment of longitudinal registration devices on the continuous web path. After a re-start, the web cut off, by a transverse cutting arrangement, does also take place at a "correct" location, i.e. at a desired location between two printed images. However, since the upstream or prior severing in the severing device took place, for example, in the middle of a printed page, a shortened product section is initially supplied to the folding apparatus. This shortened product section, because of its length, for example, is not grasped by holding devices of the subsequent transverse cutting device and can lead to considerable malfunctions, including another emergency stop. In accordance with the present method, the continuous web is severed registration-correctly. The start of the continuous web, which was obtained after this registration correct severing process is fed to the folding apparatus. By severing of the web by an additional transverse cutting arrangement, which severing is correct in registration, in regard to the web's longitudinal direction, the malfunction-free feeding of a start of a continuous web, which had been severed during an emergency stop, for example, into the subsequent or downstream, in the direction of web travel, folding apparatus is assured.

Correct registration is also problematical, in the course of an initial web draw-in, or in particular following the severing of a continuous web, if the continuous web is of a width exceeding the customary width of a continuous web. This excess width can be caused by a relative displacement of individual layers, in the transverse direction with respect to each other, or also by an asymmetrical longitudinal fold, both of which can be caused, for example, by an emergency stop itself or by a malfunction which triggered the resulting emergency stop. If such a widened continuous web is now fed to the folding apparatus, this can also result in considerable malfunctions there, up to, and including another emergency stop, but at least can result in incorrect product sections. In a method in accordance with the present invention, the start of the continuous web is only fed to the folding apparatus if the width of the continuous web does not exceed the preset "normal" width of the continuous web. As long as the width of the continuous web is not correct, the continuous web or the severed parts of the continuous web are shunted away. Feeding of the start of a continuous web into the folding apparatus, free of malfunctions, which start of a continuous web was, for example, severed as a result of an emergency stop, is assured by monitoring the width of the continuous web, in regard to the web's transverse direction.

An embodiment of the present invention is particularly advantageous in which both above-mentioned measures, registration-correct severing of the web, and monitoring of the width of the continuous web, are applied.

A further problem can arise if several continuous webs are to be fed together to a further processing stage, such as a folding apparatus. In order to be able to operate correctly, such a further processing stage requires an adjustment, in accordance with the thickness of the continuous web, to be processed. In a folding apparatus, this adjustment is the case at the height of the folding jaws. If, in the case of two continuous webs, to whose combined thickness the opening size of the folding jaws has been set, only one web is then fed in, it is not possible for the folding jaw to correctly clamp it. Material falling out of the folding jaws can lead to serious malfunctions. To correct this problem, in the case where two continuous webs are fed to the further processing stage, in which they are separated into product sections, in accordance with the present invention, upstream of the transverse cutting arrangement and along the path of the continuous web, at least the first of these continuous webs passes through a severing device which is operated, synchronized with a leading edge of the second continuous web. The leading edge of the second continuous web and the leading edge of the first continuous web, which are produced by the severing device, meet within the same product section in the further processing device.

The leading edges preferably both meet at a border of the product section, or both meet spaced apart from a border between two product sections. In the latter case, the first piece cut off the continuous webs and containing the leading edge is shorter than required for the product sections and the cut-off pieces of both continuous webs are not further processed. In the former case, the cut-off pieces each constitute complete product sections and can be further processed, free of errors.

If a severing device is utilized in the course of drawing-in a continuous web to be processed, and if that severing device is also intended to be usable later in case of an emergency web stop, it is necessary for the severing device to be returned to a state in which it is ready to sever the continuous web, which is assigned to it, after it has been used during the draw-in. In accordance with the present invention, this is achieved in that two elements of the severing device, which work together for severing the continuous web, have at least two degrees of freedom of movement with respect to each other. In the second degree of such freedom of movement, the two elements can be changed between a closed position, in which a provided movement, in the first degree of freedom, severs the continuous web, and an open position, in which the provided movement, in the first degree of freedom, does not sever the continuous web. If the web has been severed, in the course of drawing-in the continuous web, by the movement of the severing device in the first degree of freedom, the two elements can be brought into the open position, in the second degree of freedom, to perform, in this position, the movement in the first degree of freedom in the opposite direction without interference with the continuous web. The severing device is then again rendered ready for action by a subsequent movement of the two elements into the closed position.

Preferably, the first degree of freedom is a rotatory degree of freedom, and in particular is one which contains a coupled movement of both elements in a counterclockwise direction. Because of this, it is possible to employ elements for the severing device which are also used, in the identical form, in a downstream arranged transverse cutting arrangement, and to thereby reduce the multitude of wear spots in a web processing system comprising the severing device and a transverse cutting arrangement, which is arranged in a downstream located further processing stage.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
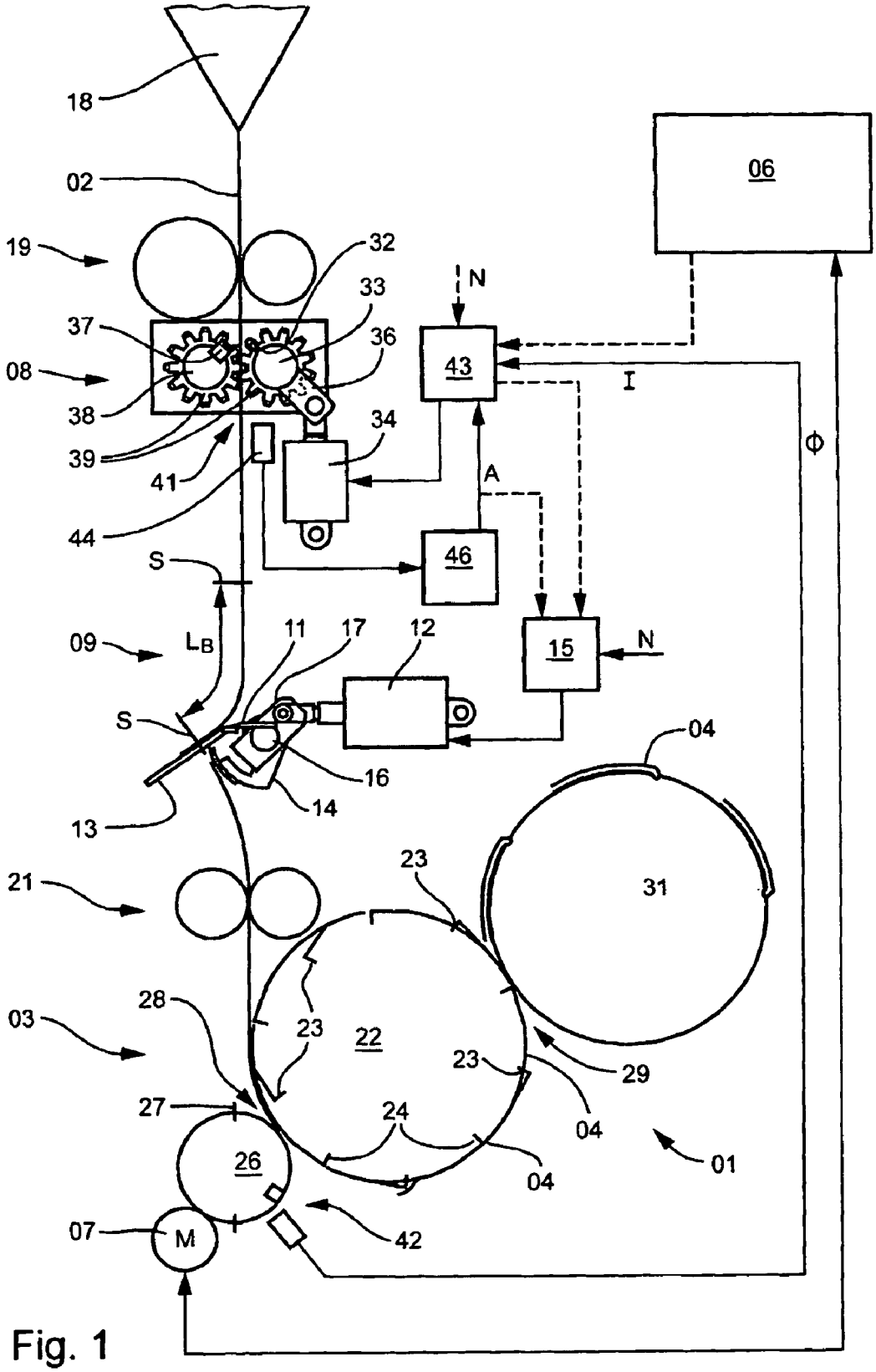
FIG. 1, a device which is usable for the dependable severing and/or feeding in of a continuous web, in a web-fed printing machine in accordance with the present invention, in FIG. 2*a*)-2*c*), depictions of three different phases, in the course of registration-correct severing of a web, in FIGS. 3*a*) and 3*b*), the monitoring of the width of the continuous web with two different results, in FIG. 4, a perspective view of a preferred embodiment of the severing device represented in FIG. 1, in FIG. 5*a*)-5*d*), a schematic depiction of the process of operation of the severing device shown in FIG. 4, and in FIG. 6, a continuous web processing system for the simultaneous processing of two fed-in continuous webs, in accordance with the present invention.
Figure 4:
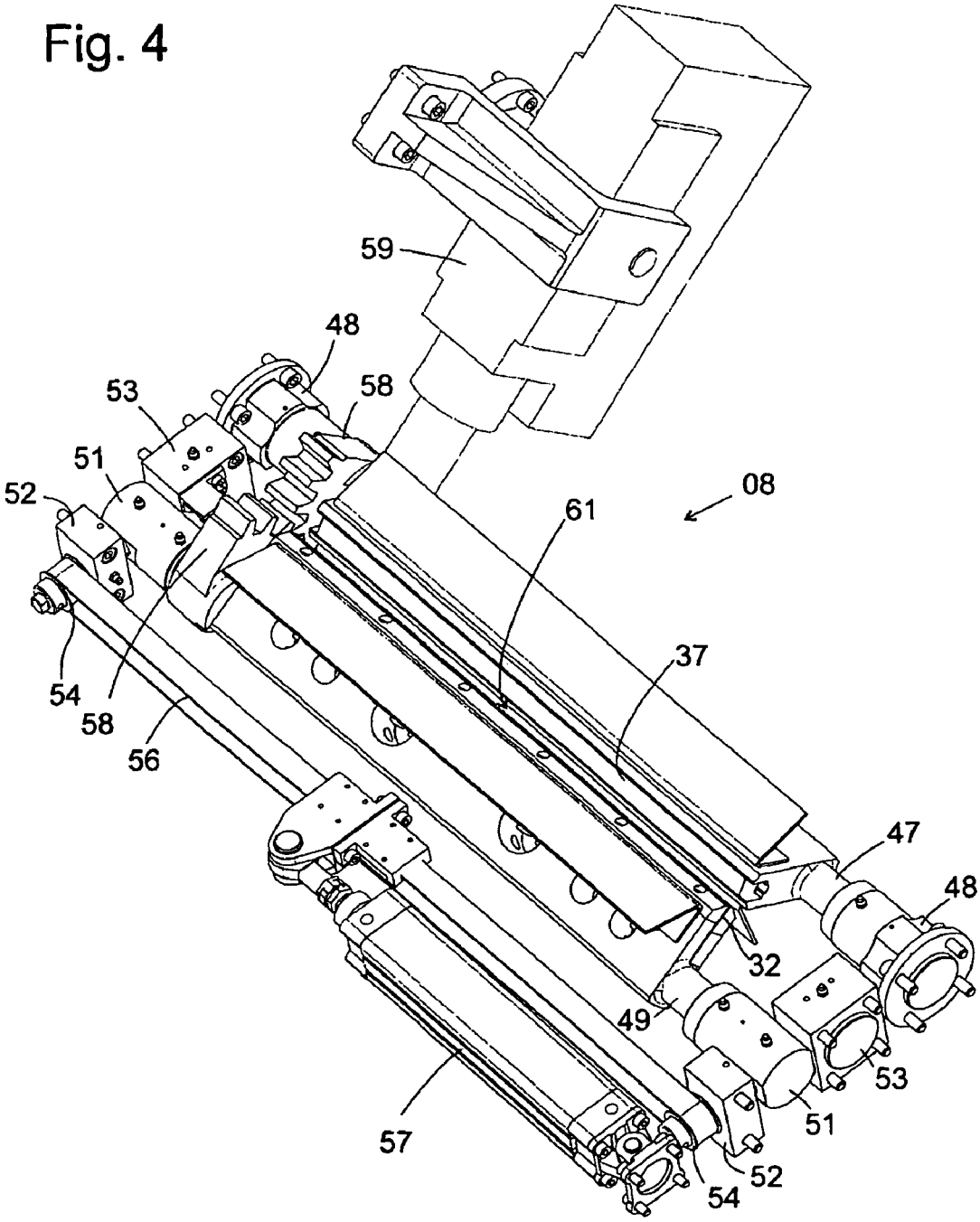

Referring initially to FIG. 1, there is schematically depicted a machine for working and/or for processing webs such as, for example, a machine for producing or processing paper, cardboard, packaging, for example by embossing or imprinting, web-shaped material. In particular there is shown a web-fed rotary printing press, in which a repeated processing pattern B, such as, for example, a printed image, is applied to one or to several webs. After a defined recurring length $L_B$, a further processing stage 01 follows, in which the web, or in which a continuous web 02, showing the repeated processing pattern, is cut into product sections 04 from one or from several such webs, as shown in FIG. 4.

The further or subsequent processing stage 01, may be, for example, a folding apparatus 01, and has at least one transverse cutting arrangement 03, in which the continuous web 02 is cut into product sections 04 in accordance with the repeated recurring length $L_B$. The transverse cutting arrangement 03 can possibly also be arranged upstream of the folding apparatus 01. For the cutting to match the recurring length $L_B$, the transverse cutting arrangement 03 and another unit, which is not specifically represented, and which applies the processing pattern, and which may be, for example a printing group, are synchronized in their operating phase. A path length of the web or webs from the unit to the cut location can be additionally adjusted, if desired, to a whole number multiple of the recurring length $L_B$ by use of a longitudinal register device, which is not represented. In the case of driving the unit and the transverse cutting arrangement 03 by a common drive motor, synchronization can be performed via a mechanical coupling. In the case of the unit and the transverse cutting arrangement 03 being preferably driven mechanically independently of each other by drive motors, synchronization can be accomplished electronically via a so-called virtual guide shaft. In this case, the virtual guide shaft is a component of a machine control device 06, which is represented schematically in FIG. 1. By specifications, in regard to the production speed, the control device can purely synthetically generate angular position set point values $\Phi$ and can pass them on to all drive mechanisms of units which are to be synchronized, as well as, for example, to a drive mechanism 07, such as a drive motor 07 which is particularly regulated in respect to its angular position driving the transverse cutting arrangement 03, or to one or to several drive mechanisms 07 of the folding apparatus 01 containing the transverse cutting arrangement 03, for example. However, for synchronization, the angular position set point values Φ of the guide shaft, and therefore of all of the remaining drive mechanisms, can also follow the position of the folding apparatus 01, or of the transverse cutting arrangement 03, via the guide shaft. The folding apparatus 01 can also be driven by the drive mechanism 07 from another one of its cylinders. In the same way, several drive mechanisms 07, which are mechanically independent of each other, such as drive motors 07 which are particularly regulated with respect to their angular position, can drive the cylinders of the folding apparatus 01.

A severing device 09, which is usable for the spontaneous severing of the continuous web 02, for example because of an emergency stop, is arranged, in the path of the continuous web 02, between the unit which applies the processing pattern 08 and the transverse cutting arrangement 03. This severing device 09 is intended to be usable for cutting through the continuous web at a short reaction time upon receipt of an appropriate command and, in an advantageous further development, to guide the now cut web simultaneously out of the continuous web path leading toward the folding apparatus. Basically, any severing device 09 can be provided for this purpose, in which a blade 11 can be moved into the continuous web path, or out of the continuous web path.

In the preferred embodiment shown in FIG. 1, the severing device 09 has a blade 11, which is pivotably seated on its shaft 16 and which blade 11 can be moved into the continuous web path, or out of the continuous web path by pivoting of the shaft 16. Pivoting of the shaft 16, and therefore of the blade 11, takes place via a lever 17, which is hinged eccentrically with respect to the shaft and which is driven by an actuating device 12 that is operated by a pressure medium. In this case, the actuating device 12 is embodied for being charged with a pressure medium by a control device 15, or an actuating member 15 which is structured, for example, as a valve, as a response to a signal N standing for an emergency stop. This signal N can originate in the machine control system or, for a short running time, can originate directly in sensors detecting an error. In an advantageous further development, the severing device 09 has a guide element 13, such as, for example, a deflecting tongue 13, which works together with the blade 11, and which, in the active state of the blade 11, blocks the operational path of the continuous web and guides the continuous web 02 out of the path leading to the folding apparatus 01. The severing device 09 can furthermore have a hoop 14, which can be pivoted together with the blade 11. This hoop 14 aids in the guiding of the newly formed start of the continuous web, again in the direction toward the folding apparatus 01, when the blade 11 is deactivated.

If an error occurs in the course of operating the machine, and wherein the continued entering of the continuous web 02, or of the webs, into the folding apparatus is to be stopped, the machine is stopped, for example, and the continuous web 02 is severed by the severing device 09. This is indicated in FIG. 1 by means of the signal N acting on the actuating member 15. This severing, typically referred to as an "emergency severing", takes place spontaneously and without consideration of a location, or a cutting line S, provided for cutting in accordance with the normal operation of the web processing apparatus. During the braking of the installation, the continuous web 02 is conducted out laterally of its usual path by the deflector tongue 13. As is shown in FIG. 1, which depicts in an operational state shortly after the first severing process, during such a so-called emergency severing, as a rule the cut which is formed by the blade 11 does not coincide with the planned cut lines between the recurring lengths $L_B$. Instead a remainder R is left over, as may be seen in FIG. 2*a*) and is typically of a length less than $L_B$ on the continuous web 02 until the start of a following recurring length $L_B$.

In the embodiment of the present invention, with the processing machine being provided as a web-fed printing press, one or several webs are first conducted over a former 18, for example, and in the process are longitudinally folded into the continuous web 02 prior to its passing through a traction group 19, the severing device 09 and a further traction group 21 at the inlet to the folding apparatus 01. The web 02 or the group of several webs is further processed in the folding apparatus 01.

The folding apparatus 01 preferably comprises a cylinder 22 which is embodied as a transport cylinder 22, such as, for example, a gripper cylinder 22 which, in the embodiment represented in FIG. 1, is equipped with five respective web leading end holding elements which the evenly distributed in the circumferential direction, for example grippers 23, and with folding blades 24. Together with a cylinder 26, which is embodied as a cutting blade cylinder 26, which is provided here with two cutting blades 27, the gripper cylinder 22 constitutes the transverse cutting arrangement 03, having a cutting gap 28. In this cutting gap 28, the continuous web 02, or the web shaped material comprised of one or of several layers, is separated into individual product sections 04, hereinafter sections 04 for short of the recurring length $L_B$, such as, for example, printed products 04 of a length each corresponding to a printed page if, for example, further processing follows, for example a further transverse fold. The holding elements 23 can also be embodied as spur strips 23 containing spur needles, and the transport cylinder 22 can be thus configured as a spur cylinder 22.

Following its passage through the cutting gap 28, a leading edge of the continuous web 02 is picked up by the holding elements 23, and specifically is picked up on the spur needles, or is clamped, in particular. In a further development, which is only schematically indicated, the holding elements 23 embodied as grippers 23 can be radially movable out of the shell surface in such a way that they lift a trailing end of a leading product section 04 in order to pick up the edge of the continuous web 02. By this movement, it is possible to receive product sections 04 on the circumference of the transport cylinder 22 without these product sections 04 being spaced apart from each other. The transport cylinder 22 can thus be operated at the speed of the continuous web without precession.

The transport cylinder 22 forms a folding gap 29 together with a further cylinder 31, such as, for example, a folding jaw cylinder 31. In the course of their passage through the folding gap 29, the folding blades 24 are extended out of the transport cylinder 22 to insert the product sections 04 along a center line into folding jaws, which are not specifically represented of the folding jaw cylinder 31. The product sections 04, which have been transversely folded in this way, are further conveyed on the folding jaw cylinder 31 to a location at which they are transferred to a paddle wheel, which is not specifically represented for being placed on a conveyor belt, or to a second longitudinal folding apparatus.

As can be seen in FIG. 1, spontaneous severing, by operation of the severing device 09, takes place, for example in case of an emergency stop as a result of an error such as, for example, a jam in the folding apparatus 01. As a result of such an emergency severing, the so-called remainder R constitutes the now leading edge of the continuous web 02. Even in a case wherein, because of its excessive length, a rerouted section of the continuous web is severed a second time, before it is again fed into the folding apparatus, a remainder R is typically left over until the next operational cut, or before the next occurring operational cutting line S. If now, the continuous web 02 containing the remainder R were fed to the folding apparatus 01, because of the synchronization with the recurring length $L_B$ a cutting of the remainder R takes place as a first operational cut in the transverse cuffing arrangement 03 which initial cut section, because of its shortened length, cannot be picked up by the holding element 23. If the risk of a further interference in the operation of the processing machine, caused by this initially shortened length cut segment is to be avoided, the remainder R would have to be removed from the folding apparatus 01 in an elaborate manner.

To avoid this elaborate process, a position or length controlled severing device 08, which can be registration-correctly controlled, is arranged, for example in addition to the severing device 09, in the path of travel of the continuous web 02 and between the unit applying the processing pattern and the transverse cutting arrangement 03. In the preferred embodiment, which is represented in the drawing figures, the severing device 09, which performs the spontaneous severing and which is described above, is arranged in the continuous web path next to the severing device 08 which can be controlled to provide a correct registration. However, in a further development of the present invention, the two functions can also be performed by only a single severing device 08, provided it additionally takes on the shunt function for removing the severed continuous web 02. Alternatively, a separate shunt is provided for this web-shunting function.

Registration-correct severing is here understood to mean the severing of the continuous web 02, or webs at an operational cutting line S, which is provided for cutting between two successive recurring length $L_B$. Thus, in the course of the entering of the edge of the new start of the continuous web formed in this way, which new web edge start coincides with the operational cutting line S, into the transverse cutting arrangement 03, this newly formed web leading edge coincides with the blade 27, which is moved synchronously with the forward movement of the continuous web 02, in the effective cutting gap 28.

The registration-correct severing device 08 can be embodied, in any appropriate way, as a severing device 08 or as a transverse cutting device 08, which is structured to transversely sever the continuous web 02, or the webs, upon receipt of a triggering signal, in response to which, a blade 32 can be moved into the continuous web path or out of the continuous web path. The registration-correct severing device 08 preferably should be configured so that the cut can be performed at least precisely defined and calculated in view of the reaction time, or the location on the passing continuous web, and/or that a clean cut without large fringes, of for example, less than 5 mm can be achieved.

In the preferred embodiment of FIG. 1, the severing device 08 has the blade 32, which is pivotably seated on a shaft 33, with the blade 32 extending perpendicularly, in respect to the longitudinal extension of the continuous web 02, and substantially parallel with the level of the continuous web. Pivoting of the shaft 33, and therefore of the blade 32, takes place, for example, by actuation of a lever 36, which lever 36 is hinged eccentrically, with respect to the shaft 33, via an actuating device 34 which is operated by a pressure medium, such as, for example, by a hydraulic or a pneumatic cylinder with a piston and a rod. In an advantageous further development, the blade 32 acts together, via the continuous web 02, with a counter support 37, such as, for example, a counter support 37 configured as a counter blade 37 or as a cutting strip 37, and wherein they form a cutting groove 41 when working together. This counter blade 37 is either seated fixed in place, or as represented in FIG. 1 is, in an advantageous embodiment, also pivotably arranged on the other side of the continuous web 02. To this end the counter blade 37 is also arranged on a shaft 38, which shaft 38 extends parallel with the shaft 33 and which shaft 38 is driven via a positive driving connection 39, such as, for example, by a gear wheel pair 39 that are connected with the respective shafts 33, 38, and synchronously with the shaft 33, but in the opposite direction from shaft 33. When actuating the controlled web severing device actuator 34, such as, for example, when an actuator rod connected with the lever 36 is extended, the lever 36 is pivoted upward, from its position shown in FIG. 1 in a counterclockwise direction, and pivots the shaft 33, which is connected fixed against relative rotation with it, together with the blade 32 into the cutting groove 41. By operation of the driving connection 39, the counter blade 37 moves in the opposite direction of the blade 32 until both work together in the area of the connecting line between the shafts 33, 38 for severing the continuous web 02. Depending on the thickness of the continuous web 02, cutting of the web 02 takes place more or less prior to reaching the connecting line, which thickness dependent cutting should be advantageously taken into consideration when controlling the severing device in regard to the intended cutting line S.

The blade 32 is preferably of the same construction as the blades 27 of the blade cylinder 26, so that the same replacement can be used for both. In the same way, the counter blade 37 or the cutting strip 37 is identical with a corresponding portion of the transport cylinder 22, which is acting together with the blades 27.

The phase of the actuation of the severing device 08 is correlated with the transverse cutting arrangement 03. Registration-correct triggering of the severing device 08, for subsequent operational cutting, or in other words, its triggering at the right moment, with respect to the forward moving continuous web 02, takes place on the basis of a signal formed in connection with status information I, and in particular, in accordance with phase information I, and which is referred to as signal I, for short, regarding the operational transverse cutting arrangement 03 of the folding apparatus, for example. In connection with a transverse cutting arrangement 03 which is based on rotating blades 27, this phase information I represents an angle information of the blade cylinder 26 that is driven synchronously with the continuous web 02. As represented in FIG. 1, the phase information I can be advantageously obtained directly at the cutting blade cylinder 26 by the use of an appropriate detection system 42, such as, for example, a sensor which is working together with an initiator which is connected, fixed against relative rotation, with the blade cylinder 26. In that case, this initiator has a fixed, exactly selected angular relationship with the controlled web severing device 08 for registration-correct severing, so that severing by the controlled web severing device 08 takes place based on a pulse which is generated during the passage of the initiator past the sensor.

By the use of an embodiment, which is not specifically represented, it is possible to pick up the phase information at any arbitrary other component which is driven synchronously and phase-correlated in respect to the web, or continuous web 02. However, this only applies to components located upstream or downstream of the controlled web severing device 08, on whose continuous web path up to the transverse cutting arrangement 03 and up to the severing device 08 no longitudinal registration device is arranged, which longitudinal registration device would possibly change the path length. If this were the case, it would be necessary to provide a correction which would take the change in web path length into consideration as an offset.

In a representation which is shown in dashed lines in FIG. 1, the phase information I can also be derived from the master shaft of the machine control device 06. Its phase relationship is correlated, in a definite way, with the phase relationship of the folding apparatus 01, and in particular with that of the transverse cutting arrangement 03.

The phase information signal I, in the form of angle information I, or as a singular pulse at the passage of an initiator, is processed in a control device 43 and triggers the registration-correct severing process by the controlled web severing device 08. In the case of an already phase-correlated singular pulse, the control device 43 can be embodied as a simple actuating member 43, for example as a valve for charging the actuator 34 with a pressure medium. If the phase information I merely represents information regarding the momentary angular positions, the control device 43 has provisions for fixing, such as, for example, input provisions, of a definite nominal position and for an evaluation of the received phase information I in this regard.

FIGS. 2*a* to 2*c* schematically show the process of registration-correct severing, starting at the time which is already represented in FIG. 1, shortly after the spontaneous emergency stop-based severing of the web 02 by the emergency severing device 09. The structural details of the device will not be again explained in what follows and the structures are also not again provided with their various reference numerals in the schematic sequence shown in FIG. 2*a*)-2*c*).

Following the spontaneous severing of the continuous web 02, by operation of the emergency severing device 09, the continuous web 02 having the remainder R and the cutting lines S, which are identified by S1 to S4, is initially moved out of the operational continuous web path. After the stoppage of the web 02, the continuous web 02 is removed from the folding apparatus 01, or is passed through it in a controlled manner, if need be.

To accomplish an initial starting or a restarting operations, after the spontaneous severing of the web 02, the continuous web 02 is fed to the folding apparatus 01 with the correct registration. Initially, the continuous web 02 is conveyed downstream until the next cutting line S, depicted here as cutting line S4, or one of the succeeding cutting lines S, such as S5, is arranged in the cutting gap 41 of the controlled web severing device 08, as shown in FIG. 2*b*. The controlled web severing device 08, or its control device 43, receives the information regarding this arrival of the cut line S4, S5 by receipt of a signal representing the phase information I from the transverse cutting arrangement 03. Now, triggering of the controlled web severing device 08, or the activation of the actuating device 34, takes place phase-correlated with the following transverse cutting arrangement 03 at a predetermined cutting line S, here S4, as shown in FIG. 2*b*. As soon as the web start containing the remainder R is prevented, by the guide element 13, from taking the original path of web travel to the folding apparatus 01, the blade 11 of the emergency severing device 09 can again unblock the operational continuous web path by pivoting back, as seen in FIGS. 2*a, b*. An appropriate command can, for example, be issued by the control device 43 of the controlled web severing device 08 to the control member 15 of the actuating device 12 for blade 11, as shown in dashed lines in FIG. 1.

The continuous web section 02", as shown in FIG. 2*b*), which has been isolated following the second registration-correct severing at S4, can be removed from the machine. The newly formed leading edge of the continuous web 02, which coincides with a cutting line S, such as S4 here is conducted along the operational continuous web path through the emergency severing device 09, or past the blades 11 thereof, to the further processing stage 01, and, in this case, into the folding apparatus 01. Since the newly formed leading edge of the continuous web 02 coincides with an operational cuffing line, such as line S4 the first product section 04 formed by the transverse cutting arrangement 03 already has the correct recurring length $L_B$, and can be picked up by the holding device 23 of the transport cylinder 22.

Figure 5A:
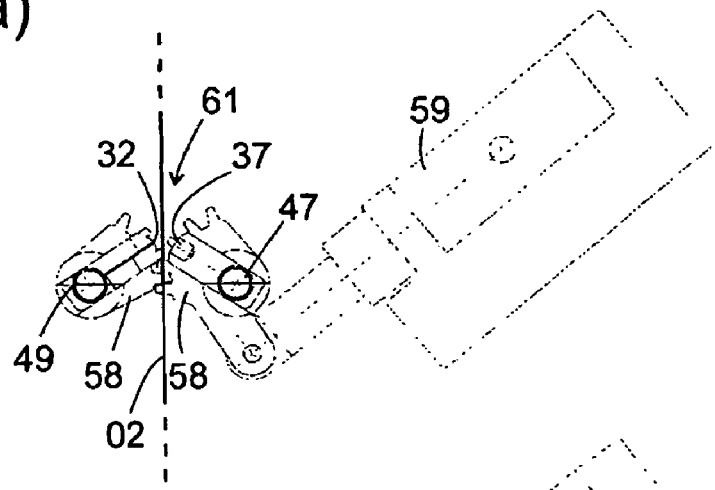

As stated above, it is possible to unite the functions of registration-correct severing and spontaneous severing, which in FIG. 1 are depicted as being performed by the separate severing devices 08 or 09 respectively, in a single severing device. This is desirable from the point of view of simplification and cost reduction. However, none of the severing devices 08, 09 in FIG. 1 is easily suited for also taking up the function of the respectively other one. The emergency severing device 09 is constructed in such a way that it laterally deflects the leading edge of the continuous web, which is formed in the course of severing and does not conduct this leading edge to the downstream arranged folding apparatus 01. Therefore, a manual intervention is required for conducting the newly formed leading edge, which would be formed by the emergency severing device 09, to the folding apparatus. However, if the device 08 for registration-correct severing of the web 02 has been employed, and is in the position shown in FIG. 2*c*, the actuating device 34 can only contract to now accomplish renewed severing, with the result that the blade 32 and the cutting strip 37 of the severing device 08 must now move in a direction which is opposite to the conveying direction of the continuous web 02. During a movement of the blade 32, and of the cutting strip 37 in the conveying direction of the continuous web 02, the blade is pulled along by the continuous web, so that the movement of the continuous web 02 aids in the severing process. The opposite effect occurs with a movement of the blade 32 in the opposite direction. In order to be able to sever the continuous web 02 at all, during such a retrograde movement, the severing device 08 requires the application of a considerably greater driving force than is required in the case of the movement of the blade along with the continuous web, and in which the individual webs 02 of the continuous web 02 more easily tear than being cleanly cut. A multi-use severing device 08, which is suitable for emergency severing as well as for controlled, registration-correct severing, is represented in a perspective plan view in FIG. 4. FIGS. 5*a*) to 5*d*) respectively show stages of a web severing process which can be performed with this multi-use severing device 08.

The basic principle of operation of the multi-use severing device 08, which is depicted in a perspective view in FIG. 4, is similar to that of the previously described controlled web severing device 08. Functionally equal or identical parts of the two are not described in detail. The cutting strip 37 is pivotably maintained on lateral walls, which are not specifically represented, by a spindle 47 and by bearing supports 48. The cutting blade 32 is seated in bearing supports 51, and pivotable by rotation of a spindle 49. In turn, these bearing supports 51 are maintained in threaded spindles, which are hidden in the drawing figure, and which spindles are rotatable around their axes in bearings 52, 53. The bearings 52, 53 are fixedly mounted on the non-represented lateral walls. Each of the threaded spindles supports a gear wheel 54 on an end projecting past the bearing 52, which gear wheel, by the use of a toothed belt 56 which is wrapped around it, is coupled with the gear wheel 54 of the respectively other spindle and with the movable piston of a linear actuating member 57, whose cylinder is fastened on one of the lateral walls. By the movement of the piston of the linear actuating member 57, the spindle 49 can be moved between a position represented in the FIG. 4, which is called a closed position, and an open position, in which the bearing supports 51 respectively touch the bearings 52.

The two spindles 47, 49 support meshing gear wheels or, as represented here, gear wheel sectors 58. The length of the teeth of these gear wheel sectors 58 is greater than the freedom of movement of the bearing supports 51 on the threaded spindles, so that the teeth of the two sectors 58 mesh in the closed, as well as in the open position.

The two spindles 47, 49, which are coupled by the gear wheel sectors 58 can be rotatorily driven by a pneumatic cylinder 59, a piston of which engages the spindle 47 by a lever, which is not specifically represented in FIG. 4.

In FIG. 4, the pneumatic cylinder 59 is extended, and the blade 32 and the cutting strip 37 are located above an imagined plane extending through the shafts of the two spindles 47, 49 in this position, blade 32 and strip 37 are ready to sever a continuous web, running from above, through the gap 61 between the blade 32 and the cutting strip 37.

The same position is shown in FIG. 5*a*) in a simplified sectional representation, in which the pneumatic cylinder 59, the spindles 47, 49, the blade 32, the cutting strip 37, as well as a continuous web 02 passing downward through the gap 61 can be seen.

Figure 5B:
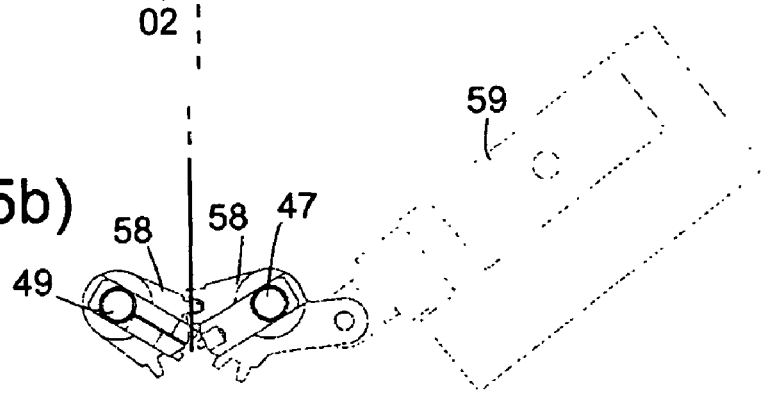

To perform an emergency severing process or to accomplish a registration-correct severing of the continuous web 02, the piston of the pneumatic cylinder 59 is abruptly retracted. Because of this piston retraction, the spindle 47 pivots in a counterclockwise direction in the representation of FIG. 5*a*). The spindle 49, which is coupled by the gear wheel sectors 58 to the spindle 47 moves in a clockwise direction, and the blade 32 and the cutting strip 37 move downward through the gap, past a position in which both levels defined by the axes of the spindles 47, 49 touch, and cut through the continuous web 02. Blade 32 and strip 37 have now moved as far as into the position represented in FIG. 5*b*). As soon as the downwardly extending continuous web 02 has been clamped between the blade 32 and the cutting strip 37, the movement of the continuous web 02 aids the pivot movement of blade 32 and strip 37, and therefore aids the severing process. In the course of cutting the continuous web 02, the blade 32 and the cutting strip 37 must reach a web speed which is identical to that of the continuous web to be cut, or which is greater than the web speed, in order to prevent the trailing portion of the continuous web from becoming jammed upstream of the severing device and thus leading to running problems with the continuous web.

If the severing process was accomplished as a registration-correct severing process, the continuous web 02 is not stopped after severing, as was described above, but instead now continues to move uniformly through the gap 61. It is therefore not possible to return the controlled web severing device 08 from the configuration shown in accordance with FIG. 5*b*) directly to the configuration shown in accordance with FIG. 5*a*) by the renewed extension of the pneumatic cylinder 59, in order to prepare the controlled web severing device 08 for a renewed severing operation, without severing the continuous web 02 again in the process.

Figure 5C:
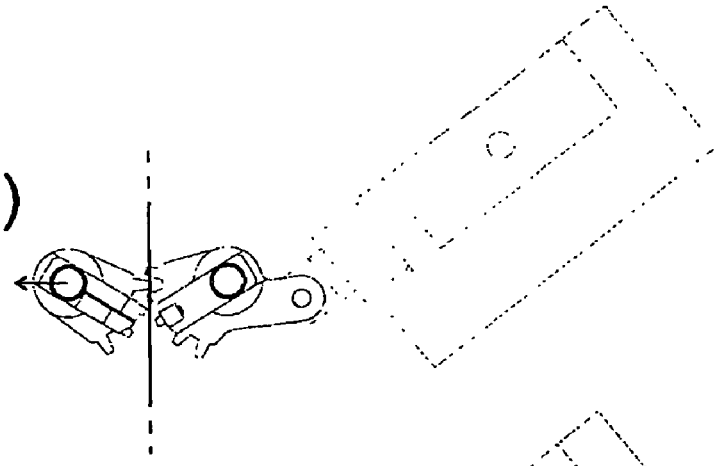

After accomplishing a successful severing using the controlled web severing device 08 of FIG. 4, the linear actuating member 57 is therefore actuated in order to shift the spindle 49 out of the closed position and into an open position, in which open position its distance from the spindle 47 is increased by at least the thickness of the continuous web 02. The engagement between the teeth of the gear wheel sectors 58 is maintained during such a shifting of spindle 49. FIG. 5*c*) shows this spindle-shifted state.

Figure 5D:
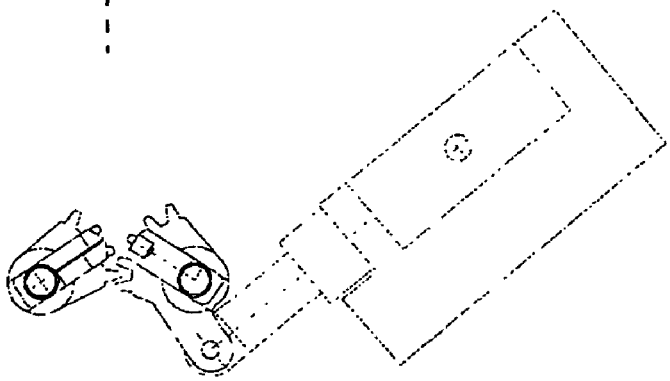

The pneumatic cylinder 49 is again extended from the configuration shown in FIG. 5*c*, so that the blade 32 and the cutting strip 37 again pass through the plane of the spindle axes and take up the position shown in FIG. 5*d*. Since, in this case, in the course of their respective passing through the plane of the spindle axes, the distance between the blade 32 and the cutting strip 37 becomes at least equal to the thickness of the passing continuous web 02, the latter is not severed. The linear actuating member 57 is now extended again so that the configuration of FIG. 5*a*) is restored. Now, by a renewed movement into the configuration of FIG. 5*b*), the severing device 08 can again perform an emergency web severing process, or also can perform a further registration-correct severing operation.

In an advantageous further development of the present invention, a device for use in the dependable severing and/or feeding of the continuous web 02 can, in principle, have a device for monitoring a width b02 of a continuous web, as seen in FIG. 3, and/or a position of a continuous web, independently of the arrangement of a registration-correct severing device 08, but in addition to such a one.

The device for use in monitoring the width b02 of the continuous web has one or several detectors 44, which scan at least the two longitudinal edges of the continuous web 02, or of the web or the webs. As represented in FIG. 3, in cross section, the continuous web 02 has a folded or closed edge constituting the folded spine, and an open edge. By way of example, two detectors 44 are represented in FIG. 3, each having a light source, such as IR, UV or visible light and a sensor. However, the detector 44 can also be embodied as a sensor which is based on measuring reflections without a light source, or as a sensor detecting changes in magnetic or electrical fields. As represented in FIG. 3, several, such as, for example two, detectors 44 can be provided, which detectors 44 each extend over a partial area of, or even over the entire width of the web 02 to be detected. For local resolution of the web edge, and embodiment of the respective sensor or detector 44 as a photo-diode array is advantageous, which photo-diode array can be evaluated, with respect to the position of the edge, by the use of appropriate software. The detector 44, or the detectors, can also be embodied as a camera, such as, for example, as a CCD camera, whose images are evaluated by appropriate evaluation software, with regard to the position of the edges, or their spacing.

Now, the width b02 of the continuous web, or a signal representing it, is determined in either the above mentioned detector 44, or in a circuit or in software to be assigned to the detectors 44, and is compared, in a logical unit 46, such as a comparator, summing member with an inverting input, computing unit, or the like with a predetermined, however preferably changeable maximum value M, or with a signal representing the maximum value. In another case, in which no circuit or software, which evaluates the width b02 of the continuous web, is assigned to the detectors 44, the logical unit 45 can have appropriate provision for evaluating the signal from the detector 44 in regard to the width b02 of the continuous web, as well as provision for comparing the signals representing the width b02 of the continuous web and the maximum value M. In FIG. 3*a* the maximum width M is not exceeded, for example an output signal A of 0 is present at the output of the unit. A continuous web 02 having webs which are laterally shifted, with respect to each other and in addition having an incorrect longitudinal fold of the inner layer is represented, by way of example, in FIG. 3*b*. In this case, the width b02 of the continuous web exceeds the predetermined maximum width M, so that a number 1 appears at the output of the unit 46.

In a device for accomplishing the dependable feeding of the continuous web 02, which device is independent of the registration-correct severing device 08, a response to a warning signal, such as an optical or acoustic signal, is provided by the output signal A. The movement of the machine, at a speed exceeding the draw-in speed, is then blocked, and/or driving of the folding apparatus 01 is blocked or limited to the draw-in speed.

In the case of the integration of the device for registration-correct severing and/or feeding of the continuous web 02 by the use of a registration-correct severing device 08, the result from the unit 46 enters the control device for triggering the registration-correct severing device 08 and/or for deactivating the spontaneous severing device 09.

For example, in a first control concept in accordance with the present invention, the triggering of the registration-correct severing device 08 is only possible if, initially, the phase of the continuous web 02 is correlated with the phase of the transverse cutting arrangement 03, i.e. the phase information I fits, and additionally the maximum width M is not exceeded. To this end, the signal A is fed to the control unit 43 and is logically taken into consideration there.

In another control concept in accordance with the present invention, the signal A from the logical unit 46 does not act on the control unit 43, but instead acts on the control unit 15. The operational continuous web path is only unblocked by the spontaneous severing device 09, such as, for example, by reverse pivoting of the blade 11, if the maximum width M is not exceeded. The web sections, which have possibly been registration-correctly severed by the severing device 08 in spite of the maximum width M having been exceeded on the basis of the phase information I, are shunted out by the emergency severing device 09 until the operational continuous web path has been unblocked again, as a result of an appropriate signal A.

If needed, in a third control concept, the signal A can act on the control unit 15, as well as on the control unit 43, in such a way that, as long as the maximum width M of the web 02 is exceeded, no registration-correct severing takes place, in spite of an appropriate signal I, and the operational continuous web path remains blocked. In the case of an appropriate continuous web width b02, the continuous web path is opened and registration-correct severing, by use of the controlled web severing device 08 is permitted, in response to an appropriate signal I.

In an embodiment of the present invention, which is not specifically represented, of the device for dependable severing and/or feeding, the controlled web severing device 08 is configured for performing the spontaneous severing, which is triggered by the signal N, such as an emergency stop, as well as a registration-correct severing. To this end, the signal N is, for example, supplied to an input of the control unit 43 and is given a priority for triggering the controlled web severing device 08, or the above mentioned logical triggering device, related to the signal I and/or A is bypassed and directly passed through for triggering. In a follow-up to this emergency stop triggering, the above mentioned process is performed. In an advantageous manner, it is possible to provide a shunt, which is not specifically represented, for the continuous web downstream in place of the emergency severing device 09, which blocks or unblocks the operational continuous web path on the basis of the signal I and/or A, in the manner of the above-described emergency severing device 09.

The disclosed control and/or logical units 15, 43 and/or 46 are embodied to be spatially separated from each other, as a structural unit with separate partial processes, or even can be integrated, as partial processes, into the machine control device 06.

Figure 6:
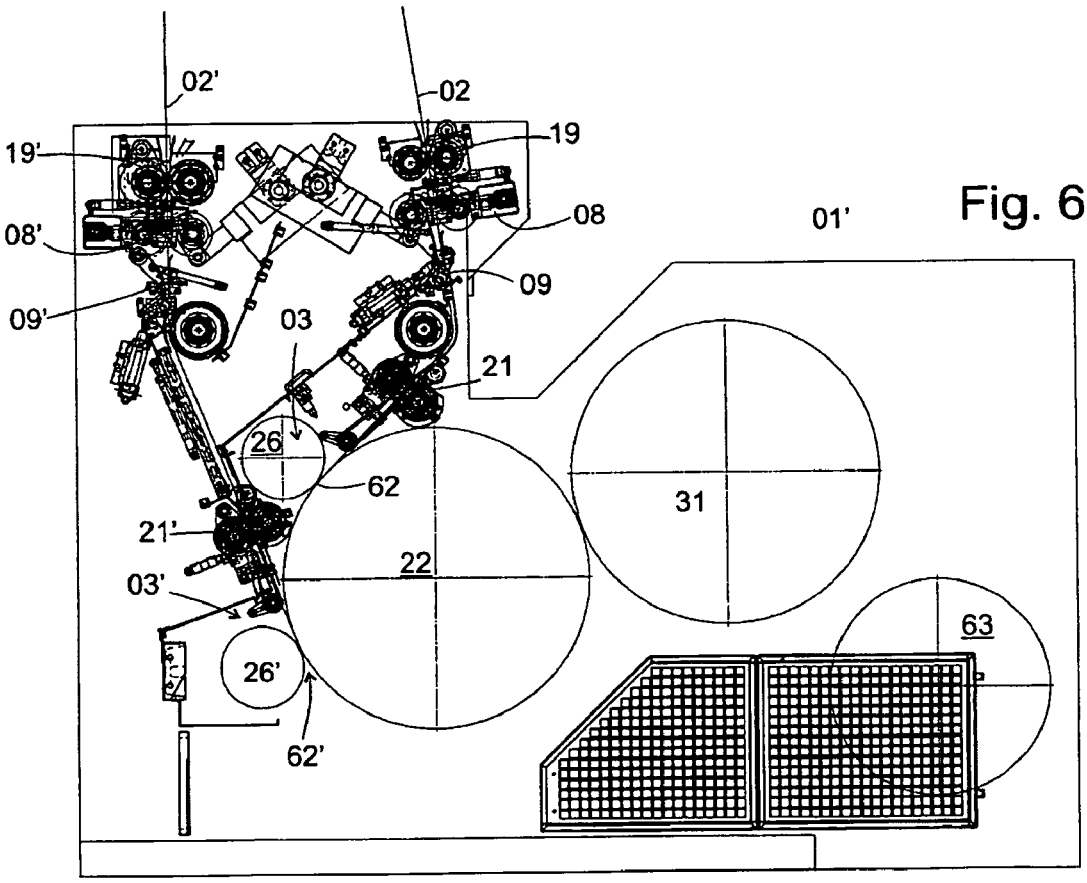

In a schematic view, FIG. 6 shows, as a further example of a continuous web processing system in accordance with the present invention, a folding apparatus 01', which is configured for the simultaneous processing of two continuous webs 02, 02'. The following elements are arranged, in order, along the paths of the continuous webs 02, 02': a catch roller pair or a traction group 19 or 19', which are usable used for maintaining a preset tension of the continuous webs 02, 02' at a former located upstream of them, which former is not represented in the drawing figure; a registration-correct web severing device 08, 08'; an emergency stop web severing device 09, 09', as well as further web traction groups 21, 21'. The continuous web 02 subsequently reaches the surface of a transport cylinder 22, which transport cylinder 22 can be embodied as a gripper cylinder or as a spur needle cylinder, and which is located downstream of the second traction group 21, at the level of a cutting gap 62 formed between the transport cylinder 22 and a first blade cylinder 26. The blade cylinder 26, in a manner the same as the corresponding blade cylinder from FIG. 1, forms, together with the transport cylinder 22, a transverse cutting arrangement 03 for severing the continuous web 02 respectively between two product sections. A second cutting cylinder 26', which is part of a second transverse cutting arrangement 03' and which, in a corresponding manner, cuts the second continuous web 02' into product sections, is offset on the circumference of the transport cylinder 22 by exactly one product length, with respect to the cutting cylinder 26.

To explain the drawing-in of continuous webs 02 and 02' into the device shown in FIG. 6, it should initially be assumed that the transport cylinder 22 is a spur needle cylinder. The case of cylinder 22 being a gripper cylinder will be considered later.

In the first controlled web severing device 08, which can be constructed as is represented in FIG. 1 or FIG. 4, the first continuous web 02 is initially severed, in a manner which is synchronized with the phase relationship of the spur needle cylinder 22, in such a way that an incomplete product section remains at the severed first continuous web 02, whose section length is preferably only slightly less than that of a complete product section, such as, for example, 90% of the length of the latter. When the leading edge of this incomplete product section encounters the spur needle cylinder 22, it does not touch the spur needles of the spur needle cylinder 22, when they are extended out of the spur needle cylinder 22, shortly before their passing through the cutting gap 62 between the cylinders 22, 26. Thus, the leading, incomplete product section passes through the cutting gap 62 without being punctured. After passing through the cutting gap 62, this leading, incomplete section is only clamped against the surface of the spur needle cylinder 22 by a roller turning along with it or by tapes.

The operation of the second controlled web severing device 08', located in the path of the second continuous web 02', is synchronized with that of the first controlled web severing device 08 in such a way that a leading edge of the second continuous web 02', obtained by the severing process, meets the leading edge of the first continuous web 02 on the surface of the spur needle cylinder 22. While this takes place, and while the first continuous web 02 is clamped to the surface of the spur needle cylinder 22, a second, complete product section of the first continuous web 02, which follows the first incomplete product section, is punctured by the extending spur needles shortly before entering the cutting gap 62 between the cylinders 22, 26. After such a puncturing, the cutting cylinder 26 separates the second, complete product section from the first incomplete product section.

The two first product sections of the two continuous webs 02, 02' then pass together through the cutting gap 62' between the cylinders 22, 26'. The circumferential speed of the spur needle cylinder 22 is slightly greater than the web speed of the two continuous webs 02, 02'. Accordingly, the incomplete first section of the first continuous web 02 has already passed completely through this second cutting gap 62' when the second cutting cylinder 26' cuts an incomplete first section of the second continuous web 02' off a following second complete product section. Here, too, the complete, second section of the second web 02' is punctured prior to cutting. The two incomplete product sections are not guided, after passing through the second cutting gap, and can fall down. The following, complete product sections are dependably punctured and are conveyed on the spur needle cylinder 22 in the customary manner, which is not being specifically described here, are transversely folded after being transferred to a folding jaw cylinder 31 and are finally delivered, by the folding jaw cylinder 31, to a paddle wheel 63.

The first and second controlled web severing devices 08, 08' can also be synchronized with the spur needle cylinder 22 in such a way that one of the continuous webs 02, 02', or also both of the webs 02, 02', are severed exactly at the border between two product sections. However, this would have no advantages for the way the device operates. Although the leading edge of each continuous web severed at the border would come into contact with the spur needles on the spur needle cylinder 22, the spur needles would not be able to penetrate this edge. Instead, they would push the edge radially outward, which could lead to jams at the respective inlet of the cutting gaps 62, 62'.

It is not required that the leading edges of the two continuous webs 02, 02' meet each other exactly on the spur needle cylinder 22. It suffices that both arrive within the same product section or field on the spur needle cylinder 22 in order to assure that not merely a single one of the two first sections is caught by the spur needles and is passed on to the folding jaw cylinder.

If the transport cylinder 22 is embodied as a gripper cylinder, its mode of operation does not differ from that of the spur needle cylinder, provided the first and second controlled web severing devices 08, 08' respectively each form incomplete first product sections on the continuous webs 02, 02'. The incomplete product sections cannot be grasped by the grippers and therefore fall to the ground as soon as they have passed through the second cutting gap 62'. An advantage results, in connection with a gripper cylinder 22, only if the severing process taking place in the first and second controlled web severing devices 08, 08' takes place exactly between two product sections, namely that already both first product sections of the continuous webs can be grasped and correctly processed. When employing a gripper cylinder, it is not permissible to sever one continuous web exactly at the border between two product sections and to sever the other web at a distance from the border. This would lead to the grippers only grasping one of the first product sections of the two continuous webs, which then later could not be correctly folded and could cause malfunctions.

Figure 2:
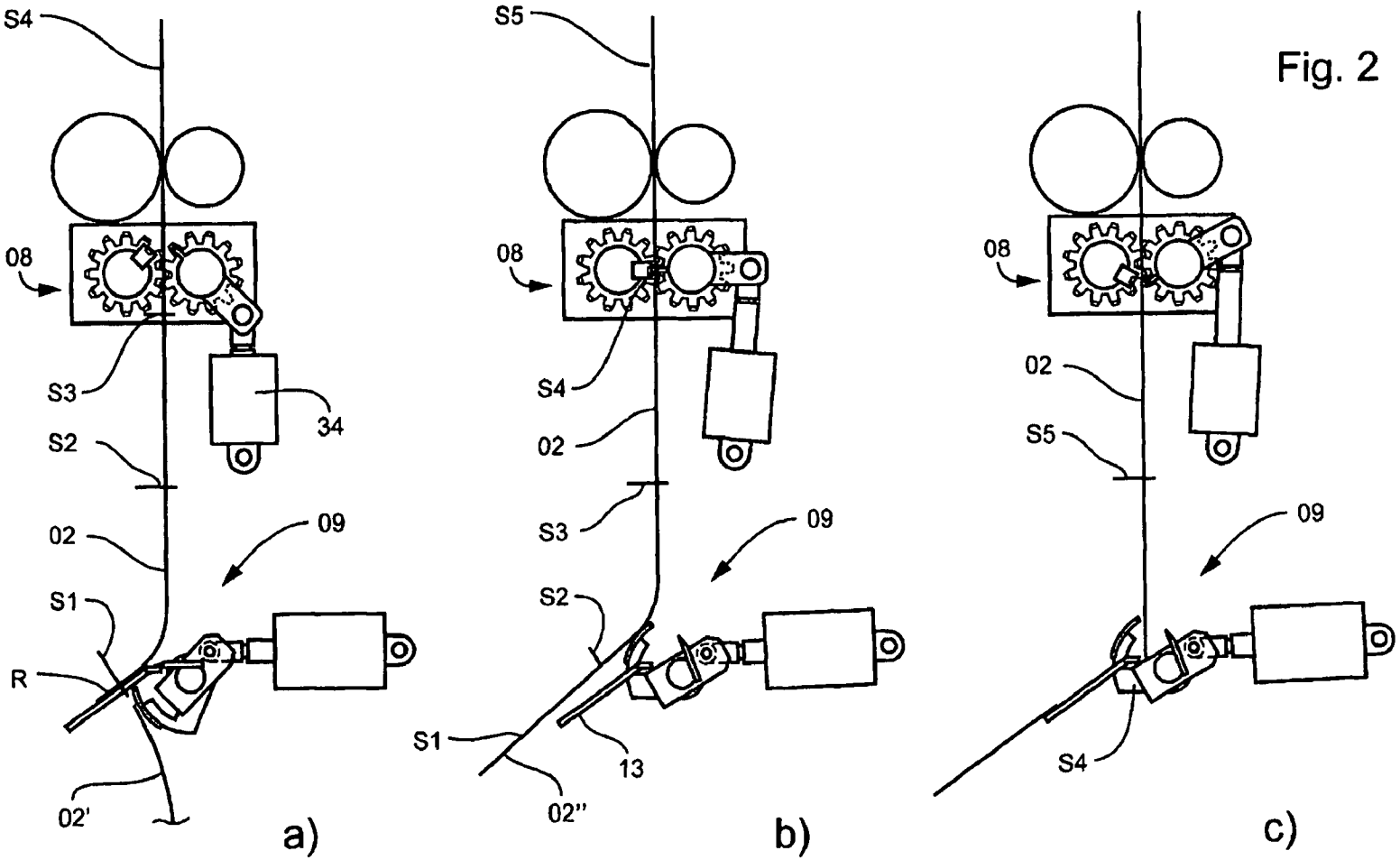

In a further developed embodiment of the present device, in accordance with FIGS. 1 to 3, which further embodiment is not represented, with the two severing devices 08 and 09, the web controlled severing device 08 is embodied with the degree of freedom of movement in accordance with the preferred embodiment shown in FIGS. 4 and 5, in addition to the first degree of freedom of movement, for example rotation, so that the controlled web severing device 08 can be brought into a closed and an open position. What was said in regard to the embodiment in accordance with FIGS. 4 and 5 should here be additionally applied to the preferred embodiment in accordance with FIGS. 1 to 3.

While preferred embodiments of a method and devices for severing sheets from and/or feeding a web into a subsequent processing stage, in accordance with the present invention, have been set forth fully and completely hereinabove, it will be apparent to one of skill in the art that various changes in, for example, the specific printing presses used, the source of the pressurized fluid, and the like could be made without departing from the true spirit and scope of the present invention, which is accordingly to be limited only by the appended claims.

What is claimed is:

1. A method for feeding a continuous web including;

providing a continuous web travel path extending in a web travel direction;

providing a web transverse cutting device located at a termination of said continuous web travel path;

using said web transverse cuffing device for cutting said continuous web into product sections;

providing a first web severing device before, in said web travel direction, and in said web travel path, said web transverse cutting device;

generating a signal evidencing a phase relationship of said web at said web transverse cutting device;

providing a signal requiring an emergency stop of travel of said web in said web travel direction;

severing said web prior to said web transverse cutting device in response to said emergency web stop signal;

accomplishing a phase-controlled severing of said web after said emergency severing of said web;

generating a fresh web start resulting from said phase-controlled severing of said web after said emergency severing of said web; and directing said fresh web start to said web transverse cutting device.

2. The method of claim 1 further including one of a drive mechanism and a cylinder in said transverse cutting device and generating said signal evidencing said phase relationship at said one of said drive device and said cylinder.

3. The method of claim 1 further including providing a virtual guide shaft for electronically synchronizing at least one drive mechanism for said transverse cutting device and at least one upstream drive mechanism and generating said signal evidencing said phase relationship from said vertical guide shaft.

4. The method of claim 1 further including providing a predefined set point phase relationship, comparing said actual phase relationship with said predefined set point phase relationship and sending a singular signal in response to agreement of said phase relationship.

5. The method of claim 4 further including providing a control unit and using said control unit for checking said signal evidencing said phase relationship with said predefined set point phase relationship.

6. The method of claim 5 further including stopping said phase-controlled severing of said web in response to no agreement between said set point phase relationship and said phase relationship.

7. The method of claim 6 further including operating said severing device in response to an agreement between said set point phase relationship and said phase relationship.

8. The method of claim 1 further including monitoring a width of said continuous web upstream of said transverse web cutting device.

9. The method of claim 8 further including monitoring said width of said continuous web with respect to a maximum web width which is not to be exceeded.

10. The method of claim 9 further including accomplishing said phase-correlated severing of said web only if said web width is no greater than said maximum web width value which is not to be exceeded.

11. The method of claim 9 further including moving said continuous web out of said web travel path while said web width is greater than said maximum web width which is not to be exceeded.

12. The method of claim 11 further including moving said continuous web out of said web travel path until said web width is no longer greater than said maximum web width which is not to be exceeded and said phase-controlled severing takes place.

13. The method of claim 1 further including using said first web severing device for accomplishing at least one of said emergency stop signal responsive web severing and said phase-controlled web severing after said emergency severing of said web.

14. The method of claim 13 further including providing said first web-severing device in an open position, providing first and second cutting elements in said first web-severing device, closing said first and second cutting elements out of an initial position and toward each other in a first degree of freedom for closing said first web-severing device in response to said emergency stop signal, moving at least one of said first and second cutting elements along a second degree of freedom for unblocking said continuous web path of travel, subsequently returning said first and second cutting elements to said initial position along said first and second degrees of freedom and again closing said first and second cutting elements in response to said signal evidencing said phase-relationship from said transverse cutting device.

15. The method of claim 1 further including providing a second web severing device, using said first web severing device for said accomplishing of said severing of said web in response to said emergency stop signal, and using said second web severing device for said accomplishing of said phase-controlled severing of said web after said emergency severing of said web.

16. The method of claim 15 further including providing said first and second web severing devices open, receiving said emergency stop signal, closing said first web-severing device while leaving said second web-severing device open, moving said continuous web out of said continuous web path; subsequently closing said second severing device in response to said phase relationship signal, cutting off said continuous web moved out of said continuous web path, moving said continuous web into said continuous web path and conveying said continuous web to said web transverse cuffing device.

17. The method of claim 1 further including blocking said continuous web travel path in response to said providing said signal requiring said emergency stop of travel of said web.

18. The method of claim 17 further including providing a controllable shunt in said continuous web travel path and using said controllable shunt for blocking said continuous web travel path.

19. The method of claim 18 further including providing a blade on said first web severing device and using said blade for blocking said continuous web travel path.

20. The method of claim 18 further including providing said shunt as one of a hoop and a deflecting tongue.

21. The method of claim 17 further including sensing a width of said web and cancelling said blocking of said continuous web travel path only if said web width is no greater than a maximum web width value.

22. The method of claim 1 further including moving said continuous web out of said web travel path until completion of said phase-correlated severing of said web after said emergency severing of said web occurs.

* * * * *